US006463842B2

(12) United States Patent
Shimizu

(10) Patent No.: US 6,463,842 B2
(45) Date of Patent: Oct. 15, 2002

(54) PISTON-TYPE COMPRESSORS WITH RECIPROCATING PISTONS

(75) Inventor: Keiji Shimizu, Isesaki (JP)

(73) Assignee: Sanden Corporation, Gunma (JP)

( * ) Notice: Subject to any disclaimer, the term of this patent is extended or adjusted under 35 U.S.C. 154(b) by 0 days.

(21) Appl. No.: 09/855,614

(22) Filed: May 16, 2001

(65) Prior Publication Data

US 2001/0045158 A1 Nov. 29, 2001

(30) Foreign Application Priority Data

May 24, 2000 (JP) ..... 2000-157966

(51) Int. Cl.[7] ..... F01B 3/00; F04B 39/00
(52) U.S. Cl. ..... 92/71; 92/169.1
(58) Field of Search ..... 92/71, 153, 154, 92/160, 249, 251, 169.1; 417/269

(56) References Cited

U.S. PATENT DOCUMENTS 4,095,921 A 6/1978 Hiraga et al.
4,594,055 A * 6/1986 Hatakeyama et al. ..... 92/251 X
4,676,143 A * 6/1987 Nomura et al. ..... 92/249 X
4,697,992 A 10/1987 Hatakeyama et al.
4,835,856 A 6/1989 Azami
5,169,162 A 12/1992 Azaml et al.
5,772,406 A * 6/1998 Takai ..... 92/153 X
2001/0003258 A1 6/2001 Fukai et al.

FOREIGN PATENT DOCUMENTS

JP 4-52473 12/1992

* cited by examiner

*Primary Examiner*—John E. Ryznic
(74) *Attorney, Agent, or Firm*—Baker Botts L.L.P.

(57) ABSTRACT

A piston-type compressor has a plurality of cylinder bores, each of which receives a piston assembly. Each piston assembly reciprocates between a top dead center and a bottom dead center in each cylinder bores. Each piston assembly includes a piston and a piston ring. A first groove is formed on an outer peripheral surface and at about a first end of the piston. The piston ring, which has a truncated cone-shape is inserted into the first groove, such that a wider edge of the piston ring opens toward a piston skirt portion of the piston and a narrower edge of the piston ring abuts a bottom surface of the first groove. A second groove is formed on an interior wall of the cylinder bore, and extends along an axial line between a crank-chamber-side end of the cylinder bore and about an end of bottom dead center position.

3 Claims, 4 Drawing Sheets

PISTON-TYPE COMPRESSORS WITH RECIPROCATING PISTONS

BACKGROUND OF THE INVENTION

1. Field of the Invention

The present invention relates to piston-type compressors for use in vehicular air conditioning systems. More particularly, it relates to cylinder bores and pistons that reciprocate within cylinder bores.

2. Description of Related Art

Piston-type compressors are known in the art. For example, Japanese Second (Examined) Utility Model Publication No. 452473 discloses a piston-type compressor. Such piston-type compressors have pistons, which reciprocate in cylinder bores. A groove is formed on an outer peripheral surface and at about a first end of the piston. A piston ring, which is a truncated cone-shaped ring and may be made of resin, is fitted into the groove formed around the outer peripheral surface of the piston. The piston ring increases the sealing efficiency during compressor operation, and thereby increases the efficiency of compressor operation.

In such piston-type compressors, because compressed gas is drawn into a space between the groove of the outer peripheral surface of the piston and an interior surface of the piston ring, the sealing efficiency between the piston and the cylinder bore is increased. On the other hand, lubricating oil included in blow-by gas is largely prevented from seeping into a crank chamber. Consequently, it is difficult to maintain lubricating oil in the crank chamber, and lubrication of components within the crank chamber may be reduced.

A piston-type compressor which maintains lubricating oil in the crank chamber is described in U.S. patent application Ser. No. 09729,321, which is incorporated herein by reference. This piston-type compressor comprises a plurality of cylinder bores and pistons, which reciprocate in cylinder bores. A piston ring, which is a truncated cone-shaped ring and may be made of resin, is fitted into the groove formed around the outer peripheral surface of the piston. An eternal diameter of the piston ring is greater than that of the piston. The piston ring is disposed in the groove, such that the wider edge of the piston ring opens toward a piston skirt portion of the piston and the narrower edge of the piston zing abuts the bottom surface of the groove. In this piston-type compressor, the piston ring is disposed in the groove of the piston, such that the wider edge of the piston ring opens toward the piston skirt portion of the piston, and only the narrower edge of the piston ring adheres to the bottom surface of the groove of the piston. Therefore, during compressor operation, the sealing efficiency of sliding members between the pistons and cylinders maintains high efficiency, and blow-by gas leaks into a crank chamber from cylinder bores at the same time. As a result, the retention of lubricating oil included in blow-by gas in the crank chamber may increase, and lubricating efficiency of sliding members in the crank chamber may increase.

SUMMARY OF THE INVENTION

A need has arisen to provide a compressor which has sufficient sealing efficiency for sliding portions between a piston and a cylinder bore, as well as which maintains sufficient lubricating oil within a crank chamber by leaking blow-by gas into the crank chamber from the cylinder bore in compressor operation.

A further need has arisen for a compressor which prevents the build-up of excess amounts of lubricating oil in the crank chamber. It is an advantage of such compressors that rubber gaskets, such as sealing members for the drive shaft at entry and exit points in the crank chamber, are not adversely effected by prolonged exposure to lubricating oil.

In an embodiment of this invention, a compressor comprises a plurality of cylinder bores and a plurality of piston assemblies. Each piston assembly reciprocates between a top dead center and a bottom dead center position one of the cylinder bores. The piston assembly comprises a piston having a first groove, which is formed on an outer peripheral surface and at about a first end of the piston. A piston ring having a truncated cone-shape is insured into the first groove, such that a wider edge of the piston ring opens toward a piston skirt portion of the piston and a narrower edge of the piston ring abuts a bottom surface of the first groove. A second groove is formed on an interior wall of at least one of the cylinder bores, and extends along an axial line between a crank-chamber-side end of the cylinder bore and about an end of bottom dead center position.

Objects, features, and advantages will be apparent to persons of ordinary skill in the art from the following detailed description of the invention and the accompanying drawings.

BRIEF DESCRIPTION OF THE DRAWINGS

The present invention may be more readily understood with reference to the following drawings.

DETAILED DESCRIPTION OF PREFERRED EMBODIMENTS

Figure 1:
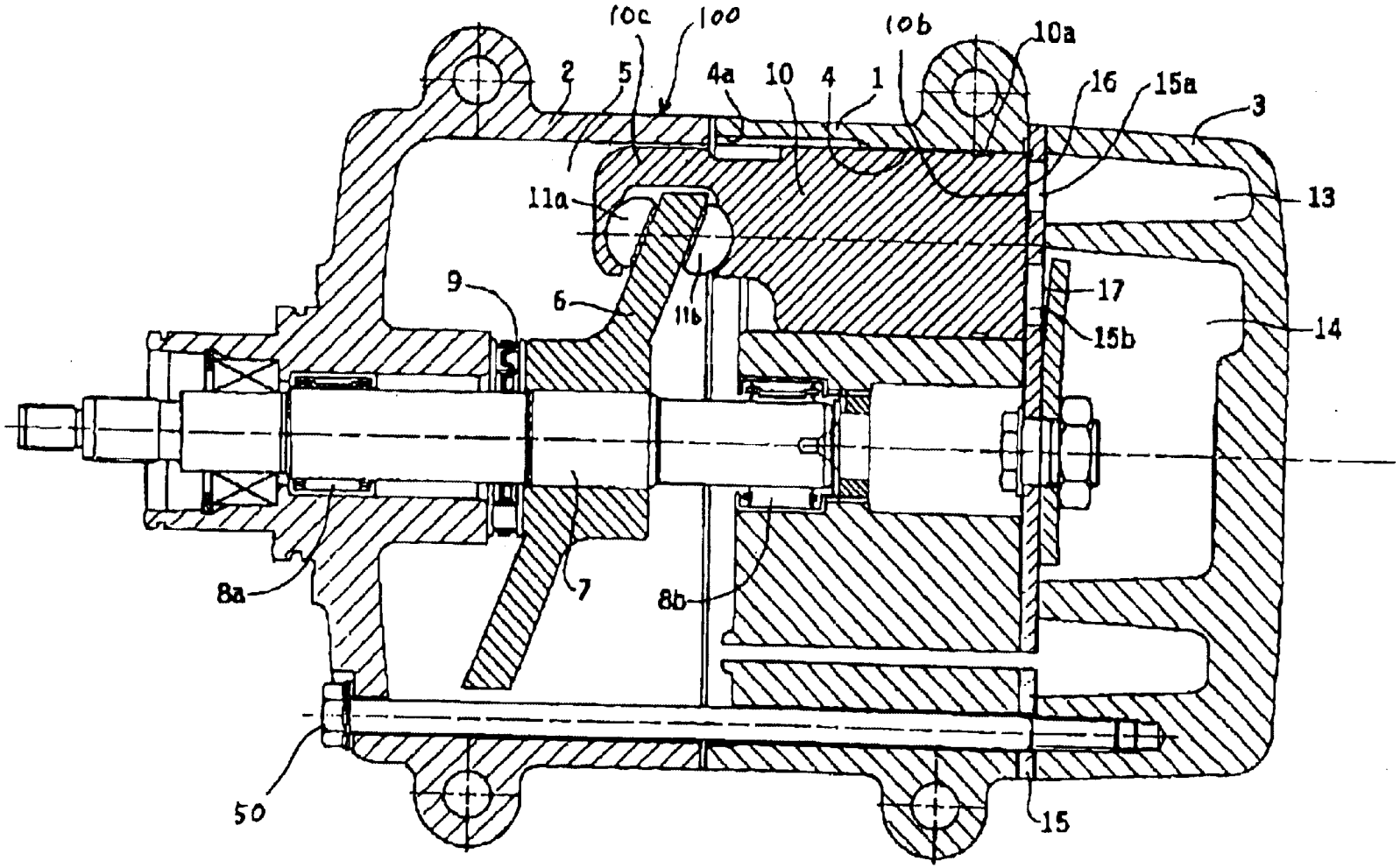
FIG. 1 is a longitudinal, cross-sectional view of a piston-type compressor, according to an embodiment of the present invention.

Referring to FIG. 1, a longitudinal, cross-sectional view of a piston-type compressor for use in an automotive air conditioning system, according to an embodiment of the present invention, is shown. The piston-type compressor includes a casing having a space into which refrigerant gas is drawn and from which compressed refrigerant gas is discharged. The shell of compressor 100 comprises a cylinder block 1, a front housing 2, a cylinder head 3, and valve plate 15. Cylinder block 1 having a cylindrical shape is closed by front housing 2 and cylinder head 3. These pars are fixed together by a plurality of bolts 50. A plurality of cylinder bores 4 are radially arranged in cylinder block 1 and are aligned with respect to the central axis of cylinder block 1. A crank chamber 5 is formed in front housing 2. A swash plate 6 is disposed in crank chamber 5 and is fixedly mounted on a drive shaft 7, which extends along a central axis of compressor 100 and through crank chamber 5. Drive shaft 7 is rotatably supported by front housing 2 and cylinder block 1 through radial bearings 8*a* and 8*b*, respectively.

Figure 2:
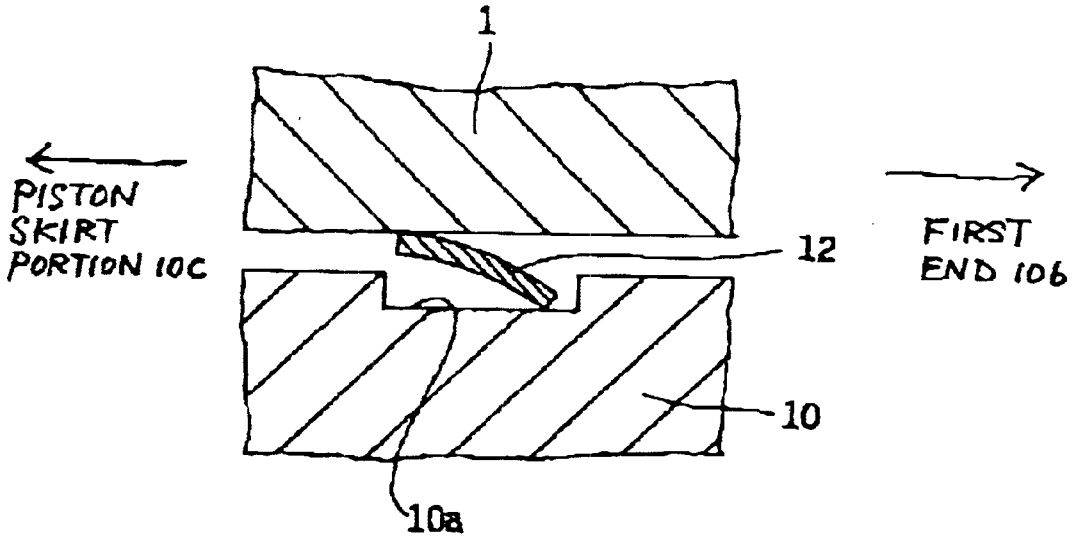
FIG. 2 is an enlarged view of an interior wall of the cylinder bore and the piston depicted in FIG. 1, according to the embodiment of the present invention.

One of pistons 10 are accommodated in each of cylinder bores 4, and pistons 10 are independently and reciprocally movable therein between a top dead center and a bottom dead center. Hemispherical shoes 11*a* and 11*b* are disposed between each sliding surface of swash plate 6 and inner surfaces of piston skirt portions 10*c* of pistons 10, so that pistons 10 may slide along the side surface of swash plate 6. A first groove 10*a* is formed on an outer peripheral surface and at about a first end 10*b* of piston 10. As shown in FIG. 2, piston ring 12, which has a truncated cone-shape, is disposed in first groove 10*a*, such that the wider edge of piston ring 12 opens toward piston skirt portion 10*c* of piston 10, and only the narrower edge of piston ring 12 abuts a bottom surface of first groove 10*a*. The wider edge of piston ring 12 abuts an interior wall of cylinder bore 4. Referring again to FIG. 1, a second groove 4*a* is formed on the interior wall of cylinder bore 4 and extends along an axial line between a crank-chamber-side end of cylinder bore 4 and about an end of a bottom dead center position of the interior wall of cylinder bore 4. The length of second groove 4*a* is greater than that of an engagement between cylinder bore 4 and piston 10 when piston 10 is at about a bottom dead center position. A suction chamber 13 and a discharge chamber 14 are formed in cylinder head 3 and are adjacent to valve plate 15. Valve plate 15 is disposed between cylinder block 1 and cylinder head 3. Suction ports 15*a* and discharge ports 15*b* are formed at valve plate 15 for each cylinder bores 4. A suction reed valve 16 opens and closes suction port 15*a*. A discharge reed valve 17 opens and closes discharge port 15*b*. A clutch (not shown), e.g., an electromagnetic clutch, is mounted on front housing 2.

In operation, when a driving force is transferred from an external driving source (e.g., an engine of a vehicle) via a known belt and pulley arrangement and the clutch, drive shaft 7 is rotated. The clutch transmits a rotating force to drive shaft 7, or disconnects a rotating force from drive shaft 7. The rotation of drive shaft 7 is transferred to swash plate 6, so that, with respect to the rotation of drive shaft 7, the inclined surface of swash plate 6 moves axially to the right and left. Consequently, pistons 10, which are operatively connected to swash plate 6 by means of shoes 11*a* and 11*b*, reciprocate within cylinder bores 4. As pistons 10 reciprocate, refrigerant gas, which is introduced into suction chamber 13 from a fluid inlet port (not shown), is drawn into each cylinder bore 4 and is compressed. A pressure from the compressed refrigerant gas opens discharge reed valve 17, and the refrigerant gas is discharged into discharge chamber 14 from each cylinder bores 4 and therefrom into a fluid circuit, for example, a cooling circuit, through a fluid outlet port (not shown). Piston ring 12 may maintain the sealing efficiency of sliding portions for pistons 10 and cylinder bores 4.

Figure 3:
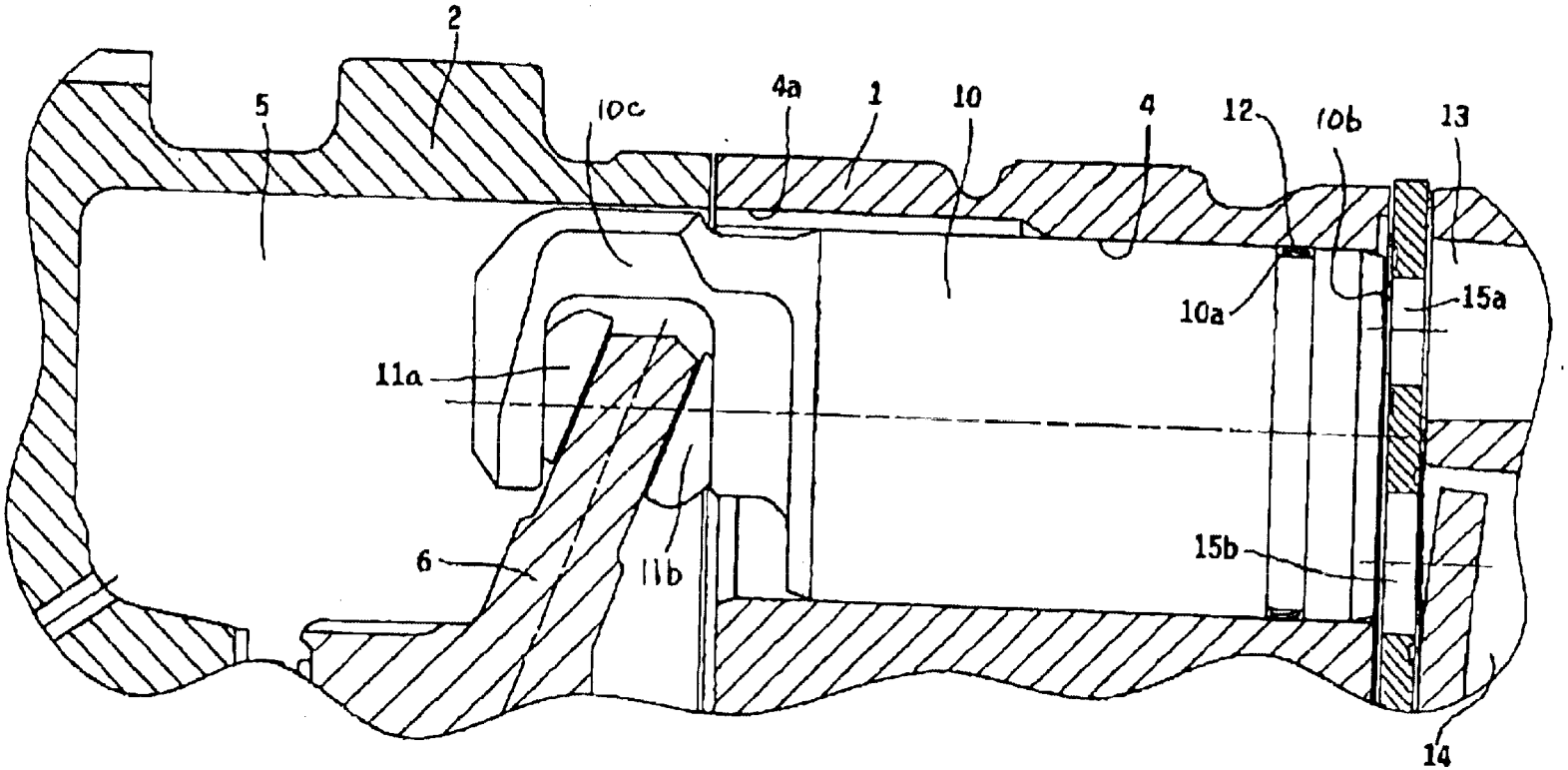
FIG. 3 is an enlarged view of the cylinder bore, the piston, and the crank chamber depicted in FIG. 1, when the piston is at about a top dead center position, according to the embodiment of the present invention.

As shown in FIG. 3, when piston 10 is at about a top dead center, piston ring 12, which is inserted into first groove 10*a*, such that the wider edge of the piston ring 12 opens toward piston skirt portion 10*c*, may slightly change its form in a radially inwardly direction due to an inner pressure of cylinder bore 4. As a result, a slightly smaller space is formed between the wider edge of piston ring 12 and the interior wall of cylinder bore 4, and a sufficient amount of blow-by gas may leak into crank chamber 5 from cylinder bore 4 through the slightly smaller space between piston 10 and cylinder bore 4 because a pressure in crank chamber 5 is lower than that in cylinder bore 4. Therefore, lubricating oil included in blow-by gas may be introduced into crank chamber 5, and lubrication of each sliding members in crank chamber 5 may increase.

Figure 4:
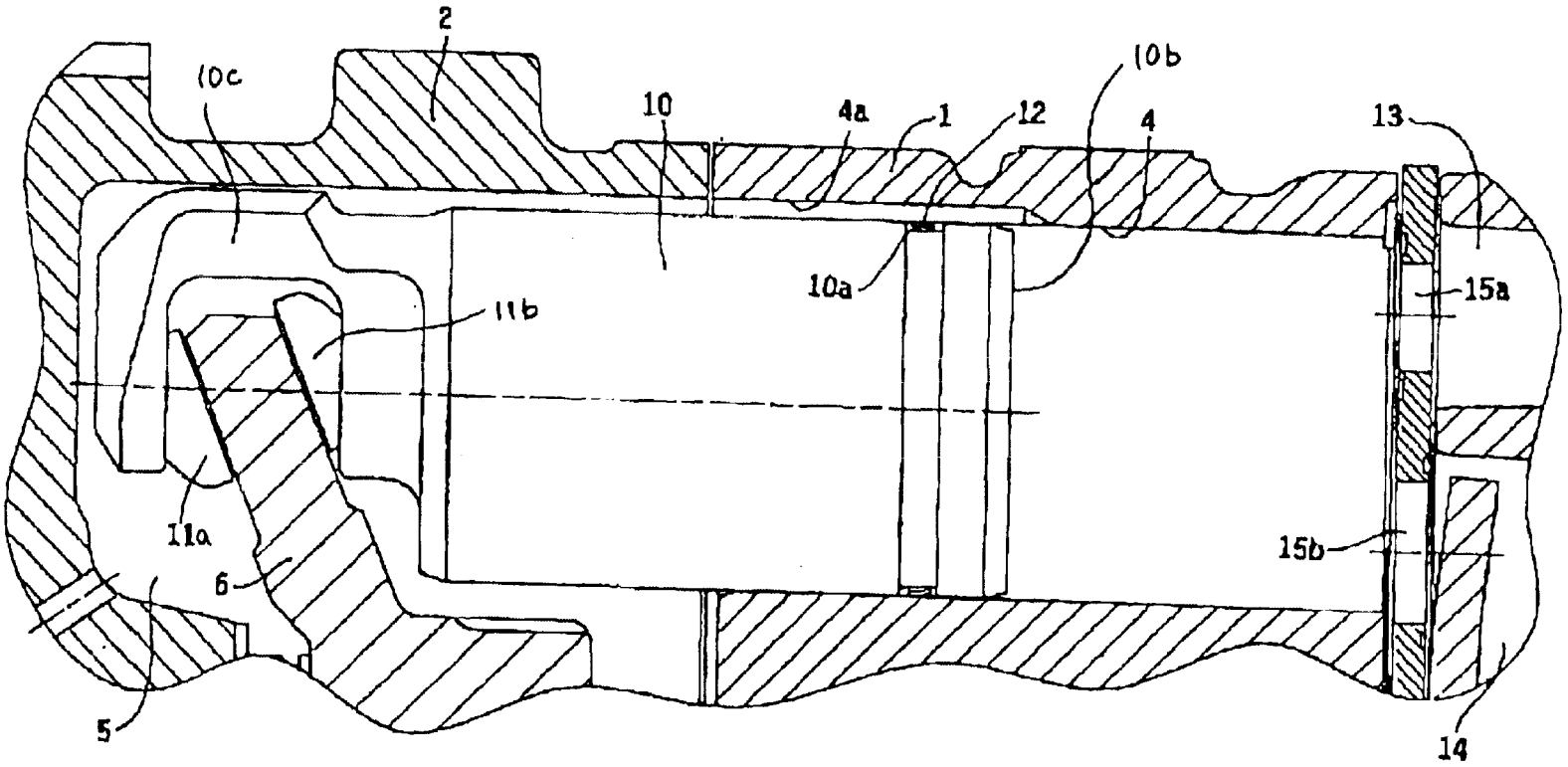
FIG. 4 is an enlarged view of the cylinder bore, the piston, and the crank chamber depicted in FIG. 1, when the piston is at about a bottom dead center position, according to the embodiment of the present invention.

As shown in FIG. 4, when piston 10 is at about a bottom dead center, crank chamber 5 communicates with cylinder bore 4 through second groove 4*a*. In this situation, because a pressure in crank chamber 5 is greater than that in cylinder bore 4, a part of blow-by gas in crank chamber returns to cylinder bore 4. Blow-by gas returned to cylinder bore 4 is compressed with refrigerant gas introduced from suction chamber 13, and discharged into an external fluid circuit through discharge chamber 14. As a result, a part of lubricating oil retained in crank chamber 5 is discharged into the external fluid circuit with blow-by gas. Therefore, a sufficient amount of lubricating oil may be maintained in crank chamber 5.

Second groove 4*a* may have a variety of cross-sectional shapes. Second groove 4*a* may be formed at all of cylinder bores 4, or may be formed at a specified cylinder bore or bores 4. A second groove 4*a* may be formed at a cylinder bore 4 or a plurality of second grooves 4*a* may be formed at a cylinder bore 4. Second groove 4*a* may be formed by cutting, or may be formed when cylinder block 1 is forged. The present embodiment of this invention is applied to the compressor having the swash plate, however, the present invention may be applied to any compressor having a piston, which reciprocates within a cylinder bore.

As described above, with respect to the embodiment of the present invention of a piston-type compressor, a piston ring, which has a truncated cone-shape, is inserted into a first groove formed on an outer peripheral surface and at about a first end of the piston, such that the wider edge of the piston ring opens toward a piston skirt portion of the piston. Therefore, during compressor operation, a sealing efficiency of sliding portions for pistons and cylinder bores may be maintained, and lubricating oil may be introduced into the crank chamber by blow-by gas, which is adequately leaked from cylinder bores to the crank chamber at the same time. Moreover, with respect to the embodiment of the present invention, a second groove is formed on the interior wall of the cylinder bore and extends along an axial line between a crank-chamber-side end of the cylinder bore and about an end of bottom dead center position of the interior wall of the cylinder bore. The length of the second groove is greater than that of an engagement between the cylinder bore and the piston when the piston is at about a bottom dead center position When the piston is at about a bottom dead center position, a part of blow-by gas in the crank chamber is returned to the cylinder bore through the second groove because a pressure in the crank chamber is greater than that in the cylinder bore. Blow-by gas returned to the cylinder bore is compressed with refrigerant gas introduced from a suction chamber, and discharged into an external fluid circuit through a discharge chamber. As a result, a part of lubricating oil retained in the crank chamber may be discharged into the external fluid circuit with blow-by gas. Therefore, a sufficient amount of lubricating oil may be maintained in the crank chamber.

Although the present invention has been described in connection with preferred embodiments, the invention is not limited thereto. It will be understood by those skilled in the art that variations and modifications may be made within the scope and spirit of this invention, as defined by the following claims.

What is claimed is:

1. A compressor comprising:

a plurality of cylinder bores; and a plurality of piston assemblies, each of which reciprocates between a top dead center and a bottom dead center position in one of said cylinder bores, each of said piston assemblies comprises a piston having a first groove, said first groove formed on an outer peripheral surface and at a first end of said piston, a piston ring having a truncated cone-shape inserted into said first groove, such that a wider edge of said piston ring opens towards a piston skirt portion of said piston, and a narrower edge of said piston ring abuts a bottom surface of said first groove, wherein a second groove is formed on an interior wall of at least one of said cylinder bores, and said second groove is positioned adjacent to and extends beyond said piston when said piston is at said bottom dead center position.

2. The compressor of claim 1, wherein a length of said second groove is greater than a length of engagement between said cylinder bore and said piston when said piston is at about a bottom dead center.

3. The compressor of claim 1, wherein said compressor is a swash plate-type compressor.

* * * * *